US009802293B1

(12) United States Patent
Hendron et al.

(10) Patent No.: US 9,802,293 B1
(45) Date of Patent: Oct. 31, 2017

(54) METHOD TO SHAPE THE SURFACE OF CHEMICAL MECHANICAL POLISHING PADS

(71) Applicant: Rohm and Haas Electronic Materials CMP Holdings, Inc., Newark, DE (US)

(72) Inventors: Jeffrey James Hendron, Elkton, MD (US); Jeffrey Robert Stack, Clayton, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 15/279,645

(22) Filed: Sep. 29, 2016

(51) Int. Cl.

| | |
|---|---|
| ***B24B 53/017*** | (2012.01) |
| ***B24B 37/24*** | (2012.01) |
| ***B24D 18/00*** | (2006.01) |
| ***B24B 53/02*** | (2012.01) |
| ***B24B 53/095*** | (2006.01) |

(52) U.S. Cl.
CPC ..... *B24B 53/017* (2013.01); *B24B 37/24* (2013.01); *B24B 53/02* (2013.01); *B24B 53/095* (2013.01); *B24D 18/0009* (2013.01); *B24D 18/0045* (2013.01)

(58) Field of Classification Search
CPC ..... B24B 37/24; B24B 49/18; B24B 53/017; B24B 53/02; B24B 53/095; B24D 18/0009; B24D 18/0045
See application file for complete search history.

(56) References Cited

U.S. PATENT DOCUMENTS 6,200,207 B1 * 3/2001 Hsu ..... B24B 53/017 451/287
6,270,396 B1 * 8/2001 Uchiyama ..... B24B 53/017 451/443

(Continued)

FOREIGN PATENT DOCUMENTS

EP 0769350 A1 4/1997

OTHER PUBLICATIONS

Luo et al.; Integrated Modeling of Chemical Mechanical Planarization for Sub-Micron IC Fabrication, Springer-Verlag Berlin Heidelberg GMBH, pp. 261-269, 2004.

(Continued)

*Primary Examiner* — Timothy V Eley
(74) *Attorney, Agent, or Firm* — Andrew E. C. Merriam

(57) ABSTRACT

The present invention provides methods for making a preconditioned chemical mechanical (CMP) polishing pad having a pad surface microtexture effective for polishing comprising grinding the surface of the CMP polishing pad having a radius with a rotary grinder while it is held in place on a flat bed platen surface, the rotary grinder having a grinding surface disposed parallel to or substantially parallel to the surface of the flat bed platen and made of a porous abrasive material, wherein the resulting CMP polishing pad has a surface roughness of from 0.01 μm to 25 μm, Sq. The present invention also provides a CMP polishing pad having a series of visibly intersecting arcs on the polishing layer surface, the intersecting arcs having a radius of curvature equal to or greater than half of the radius of curvature of the pad and extending all the way around the surface of the pad in radial symmetry around the center point of the pad.

13 Claims, 2 Drawing Sheets

(56) References Cited

U.S. PATENT DOCUMENTS

| | | | | |
|---|---|---|---|---|
| 6,302,772 | B1 * | 10/2001 | Hosoki | B24B 53/017 451/287 |
| 6,641,471 | B1 | 11/2003 | Pinheiro et al. | |
| 6,857,942 | B1 * | 2/2005 | Lin | B24B 53/12 451/443 |
| 6,899,612 | B2 * | 5/2005 | Lawing | B24B 53/017 451/527 |
| 6,939,207 | B2 | 9/2005 | Jensen et al. | |
| 7,044,697 | B2 | 5/2006 | Kodaka et al. | |
| 7,118,461 | B2 | 10/2006 | West et al. | |
| 8,597,081 | B2 * | 12/2013 | Choi | B24B 53/017 451/402 |
| 9,108,293 | B2 | 8/2015 | Nunley, Jr. et al. | |
| 2001/0053660 | A1 * | 12/2001 | Koinkar | B24B 53/017 451/56 |
| 2002/0042200 | A1 * | 4/2002 | Fawcett | B24B 37/042 438/692 |
| 2005/0178666 | A1 * | 8/2005 | Tsai | B23K 5/08 205/118 |
| 2006/0292969 | A1 * | 12/2006 | Hoshino | B24B 53/017 451/56 |

OTHER PUBLICATIONS

Lawing, et al., "Advances in CMP Pad Conditioning", Semicon West, NCAVS CMPUG Symposium on CMP Technology and Market Trends, San Francisco, CA (2015).

* cited by examiner

METHOD TO SHAPE THE SURFACE OF CHEMICAL MECHANICAL POLISHING PADS

The present invention relates to methods for use in providing pad surface microtexture in polishing pads used for chemical mechanical planarization (CMP) of substrates, such as a semiconductor substrate, a magnetic substrate, and an optical substrate, as well as to chemical mechanical polishing pads having a consistent pad surface microtexture. More particularly, the present invention relates to methods comprising grinding the surface of a CMP polishing layer with a rotary grinder having a grinding surface of a porous abrasive material to form an interface of the surface of the CMP polishing layer and the porous abrasive material, the CMP polishing layer material being held in place on a flat platen surface, such as by vacuum or a pressure sensitive adhesive.

The manufacture of polishing pads for use in chemical mechanical planarization is known to include the molding and curing of a foamed or porous polymer in a mold having the desired diameter of the final polishing pad, such as a polyurethane, followed by demolding and cutting the cured polymer in a direction parallel to the top surface of the mold to form a layer having desired thickness, for example, by skiving, and then by shaping the resulting layer, for example, by grinding, routing or embossing a final surface design into the top of a polishing pad. Previously, known methods of shaping such layers into polishing pads include injection molding the layers, extruding the layers, buffing the layers with a fixed abrasive belt and/or facing the layers to a desired thickness and flatness. These methods have limited capability to achieve a consistent pad surface microtexture required for low defectivity in polished substrates and uniform removal of material from substrates. In fact, the methods generally create a visible design, such as grooves of a given width and depth and a visible but inconsistent texture. For example, a skiving process is unreliable for pad surface shaping because the stiffness of the mold changes with mold thickness and the skiver blade continuously wears. Single point facing techniques have been unable to yield a consistent pad surface microtexture due to continuous tooling wear and lathe positioning accuracy. Pads made by injection molding processes lack uniformity owing to inconsistent material flow throughout the mold; further, the moldings tend to distort as the pad sets and cures because the curative and the remainder of the molded material can flow at different rates during injection into a confined area, especially at elevated temperatures.

Buffing methods have also been used to smooth chemical mechanical polishing pads having a harder surface. In one example of a buffing method, U.S. Pat. No. 7,118,461 to West et al. discloses smooth pads for chemical mechanical planarization and methods for making the pads, the methods comprising buffing or polishing the surface of the pads with an abrasive belt to remove material from the pad surface. Buffing was in one example followed by a successive buffing step using a smaller abrasive. The product of the methods exhibits improved planarization capability over the same pad product that was not smoothed. Unfortunately, while the methods of West et al. can smooth a pad, they do not provide a consistent pad surface microtexture and cannot be used to treat in a softer pad (Shore D hardness according to ASTM D2240-15 (2015) of pad or pad polymer matrix of 40 or less). Further, the West et al. methods remove so much material that the useful life of the resulting polishing pads may be adversely affected. It remains desirable to provide a chemical mechanical polishing pad with a consistent surface microtexture without limiting the useful life of the pad.

Conditioning of a chemical mechanical polishing pad is akin to buffing, wherein the pads are generally conditioned in use with a rotary abrasive wheel having a surface that resembles fine sandpaper. Such conditioning leads to improved planarization efficiency after a 'break in' period during which the pad is not used for polishing. It remains desirable to eliminate the break in period and provide a pre-conditioned pad that can be used for polishing right away.

The present inventors have endeavored to find methods for making pre-conditioned CMP pads that have a consistent pad surface microtexture while retaining their original surface topography.

STATEMENT OF THE INVENTION

1. In accordance with the present invention, methods to provide pre-conditioned chemical mechanical (CMP) polishing pads having a CMP polishing layer of one or more polymer, preferably a polyurethane, the CMP polishing layer having a radius, and having a surface roughness of from 0.01 μm to 25 μm, Sq, and having a pad surface microtexture effective for polishing comprise grinding the surface of a polymeric, preferably, polyurethane or polyurethane foam, CMP polishing layer, more preferably, a porous CMP polishing layer, with a rotary grinder while the CMP polishing layer is held in place on a flat bed platen surface, such as by a pressure sensitive adhesive or, preferably, a vacuum, the rotary grinder comprising a rotor and having a grinding surface disposed parallel to or substantially parallel to the surface of the flat bed platen and made of a porous abrasive material to form an interface of the surface of the CMP polishing layer and the porous abrasive material.

2. In accordance with the methods of the present invention as recited in item 1, above, wherein the CMP polishing layer has a radius extending from its center point to its outer periphery and the rotary grinder has a diameter equal to or greater than the radius of the CMP polishing layer or, preferably, equal to the radius of the CMP polishing layer.

3. In accordance with the methods of the present invention as recited in item 2, above, wherein the rotary grinder is positioned so that its outer periphery rests directly over the center of the CMP polishing layer during grinding.

4. In accordance with the methods of the present invention as recited n any one of items 1, 2 or 3, above, wherein the rotary grinder and the CMP polishing layer and flat bed platen each rotate during the grinding of the CMP polishing layer. Preferably, the flat bed platen rotates in the opposite direction as the rotary grinder.

5. In accordance with the methods of the present invention as recited in item 4, above, wherein the rotary grinder rotates at a rate of from 50 to 500 rpm or, preferably, from 150 to 300 rpm and the flat bed platen rotates at a rate of from 6 to 45 rpm or, preferably, from 8 to 20 rpm.

6. In accordance with the methods of the present invention as recited in any one of items 1, 2, 3, 4 or 5, above, wherein the rotary grinder is positioned above the CMP polishing layer and flat bed platen during the grinding, and the rotary grinder is fed downward from a point just above the CMP polishing layer surface at a rate of from 0.1 to 15 μm/revolution or, preferably, from 0.2 to 10 μm/revolution, i.e. to shrink the interface of the surface of the CMP polishing layer and the grinding surface of the rotary grinder and grind the top surface of the CMP polishing layer.

7. In accordance with the methods of the present invention in any one of items 1, 2, 3, 4, 5, or 6, above, wherein prior to the grinding, the CMP polishing pad is formed by molding the polymer and skiving the molded polymer to form the CMP polishing layer for use as the pad, or, preferably, is formed by molding the polymer and skiving the molded polymer to form the CMP polishing layer followed by stacking the CMP polishing layer on top of a subpad or subbing layer having the same diameter as the CMP polishing layer to form the CMP polishing pad.

8. In accordance with the methods of the present invention as recited in any of items 1, 2, 3, 4, 5, 6, or 7, above, wherein the porous abrasive material is a composite of a porous material continuous phase having dispersed within it finely divided non-porous abrasive particles, such as silicon carbide, boron nitride or, preferably, diamond particles.

9. In accordance with the methods of the present invention as recited in item 8, above, wherein the porous abrasive material has an average pore diameter of from 3 to 240 μm or, preferably, from 10 to 80 μm.

10. In accordance with the methods of the present invention as recited in any one of items 8 or 9, above, wherein the porous continuous phase of the porous abrasive material comprises a ceramic, preferably, a sintered ceramic, such as alumina or ceria.

11. In accordance with the methods of the present invention as recited in any of items 1, 2, 3, 4, 5, 6, 7, 8, 9 or 10, above, wherein during the grinding, the method further comprises blowing compressed inert gas or air intermittently or, preferably, continuously, into the interface of the surface of the CMP polishing layer material and the grinding surface of the rotary grinder so as to impinge upon the porous abrasive material, preferably, from a point above the center point of the CMP polishing layer through the interface of the surface of the CMP polishing layer material and the grinding surface of the rotary grinder or, more preferably, from a point above the center point of the CMP polishing layer through the interface of the surface of the CMP polishing layer material and the grinding surface of the rotary grinder and, separately, blowing the gas or air upward from a point just below the periphery of the rotary grinder, for example, where the periphery of the CMP polishing layer and the periphery of the rotary grinder come together, so as to impinge upon the porous abrasive material. The blowing of the compressed gas or air can also take place before or after the grinding.

12. In accordance with the methods of the present invention as recited in any of items 1, 2, 3, 4, 5, 6, 7, 8, 9, 10, or 11, above, wherein the CMP polishing layer comprises a porous polymer or filler containing porous polymer material that has a Shore D hardness according to ASTM D2240-15 (2015) of from 20 to 80, or, for example, 40 or less.

13. In accordance with the methods of the present invention as recited in any of items 1, 2, 3, 4, 5, 6, 7, 8, 9 10, 11, or 12, above, wherein the CMP polishing layer further comprises one or more, non-porous, clear window sections, such as those comprising a non-porous polyurethane having a glass transition temperature (DSC) of from 75 to 105° C., such as window sections not extending over the center point of the CMP polishing layer.

14. In accordance with the methods of the present invention as recited in any of items 1, 2, 3, 4, 5, 6, 7, 8, 9 10, 11, 12 or 13, above, wherein the CMP polishing layer is striated and comprises a plurality of pores or microelements, preferably, polymeric microspheres, having an average particle size of from 10 to 60 μm.

15. In accordance with the methods of the present invention as recited in item 14, above, wherein the CMP polishing layer has annular bands of alternating higher density and lower density extending outward from the center point of the CMP polishing layer toward its outer periphery.

16. In accordance with the methods of the present invention as recited in item 15, above, wherein the higher density annular bands have a density of from 0.01 to 0.2 g/cm$^3$ higher than the lower density annular bands.

17. In another aspect of the present invention, chemical mechanical (CMP) polishing pads comprise a CMP polishing layer, preferably, a porous CMP polishing layer, of one or more polymer, the CMP polishing layer having a radius and having a surface roughness of at least 0.01 μm to 25 μm, Sq, or, preferably, from 1 μm to 15 μm, Sq, and having a series of visibly intersecting arcs on the polishing layer surface and having a radius of curvature equal to or greater than half, preferably, equal to half the radius of curvature of the CMP polishing layer. Preferably, the series of visibly intersecting arcs extends all the way around the surface of the polishing layer in radial symmetry around the center point of the polishing layer.

18. In accordance with the polishing pads of the present invention as recited in item 17, above, the CMP polishing layer having annular bands of alternating higher density and lower density extending outward from the center point of the CMP polishing layer toward its outer periphery.

19. In accordance with the polishing pads of the present invention as recited in any one of items 17 or 18, above, the polishing pads having one or more non-porous and clear window sections, such as those formed by a non-porous polyurethane having a glass transition temperature (DSC) of from 75 to 105° C., not extending over the center point of the CMP polishing pad, wherein the one or more window sections has a top surface defined by a window with a peak-valley of 50 μm or less over the largest dimension of the window, such as the diameter of a round window, or the larger of the length or width of a rectangular window.

20. In accordance with the polishing pads of the present invention as recited in any one of items 17, 18 or 19, above, wherein the thickness of the polishing pad is sloped to become greater closer to its center point, or is sloped to become greater further away from its center point.

21. In accordance with the polishing pads of the present invention as recited in any one of items 17, 18, 19, or 20, above, wherein the CMP polishing layer is stacked on a subpad or subbing layer, such as a polymer, preferably, polyurethane, impregnated nonwoven mat.

22. In accordance with the polishing pads of the present invention as recited in any one of items 17, 18, 19, 20, or 21, above, wherein the CMP polishing layer comprises a porous polymer or a filled porous polymer material that has a Shore D hardness according to ASTM D2240-15 (2015) of from 20 to 80, or, for example, 40 or less.

Unless otherwise indicated, conditions of temperature and pressure are ambient temperature and standard pressure. All ranges recited are inclusive and combinable.

Unless otherwise indicated, any term containing parentheses refers, alternatively, to the whole term as if no parentheses were present and the term without them, and combinations of each alternative. Thus, the term "(poly) isocyanate" refers to isocyanate, polyisocyanate, or mixtures thereof.

All ranges are inclusive and combinable. For example, the term "a range of 50 to 3000 cPs, or 100 or more cPs" would include each of 50 to 100 cPs, 50 to 3000 cPs and 100 to 3000 cPs.

As used herein, the term "ASTM" refers to publications of ASTM International, West Conshohocken, Pa.

As used herein, the term "thickness variation" means the value determined by the maximum variation in polishing pad thickness.

As used herein, the term "substantially parallel" refers to an angle formed by the grinding surface of the rotary grinder and the top surface of the CMP polishing layer or, more particularly, an angle of from 178° to 182°, or, preferably, from 179° to 181° which is defined by the intersection of a first line segment running parallel to the grinding surface of the rotary grinder and ending at a point above the center point of the CMP polishing layer and a second line segment running from the end of the first line segment and parallel to the top surface of the flat bed platen and ending at the outer periphery of the flat bed platen, wherein the first and second line segments are within a plane that is normal to the flat bed platen and that runs through the center point of the CMP polishing layer and the point on the periphery of the grinding surface of the rotary grinder located furthest from the center point of the CMP polishing layer.

As used herein the term "Sq." when used to define surface roughness means the root mean square of an indicated number surface roughness values measured at indicated points on the surface of a given CMP polishing layer.

As used herein, the term "surface roughness" means the value determined by measuring the height of a surface relative to the best fitting plane that represents a horizontal surface parallel to and located on the top surface of a given CMP polishing layer at any given point on that top surface; Svk refers to valley depths measured in low areas; and Spk refers to peaks measured in high areas. An acceptable surface roughness ranges from 0.01 μm to 25 μm, Sq, or, preferably, from 1 μm to 15 μm, Sq.

As used herein, the term "wt. %" stands for weight percent.

Figure 1:
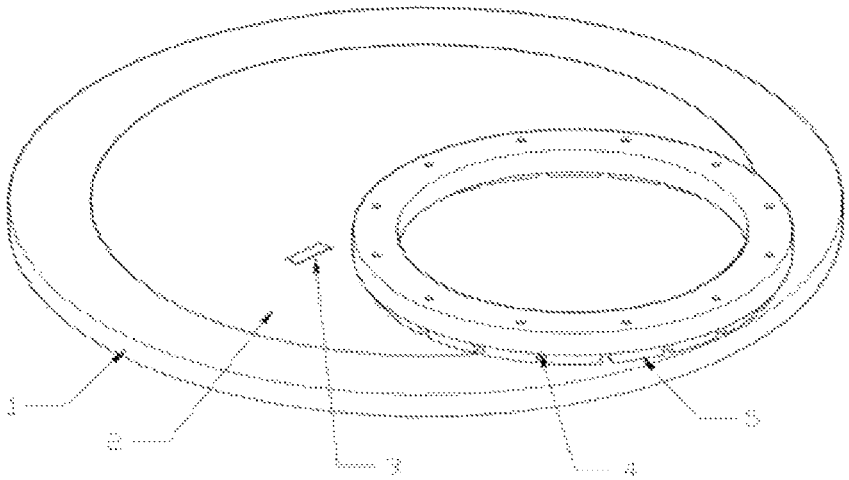
FIG. 1 depicts an embodiment of the rotary grinder of the present invention and shows a flat bed platen, and a CMP polishing layer containing a clear window.
Figure 2:
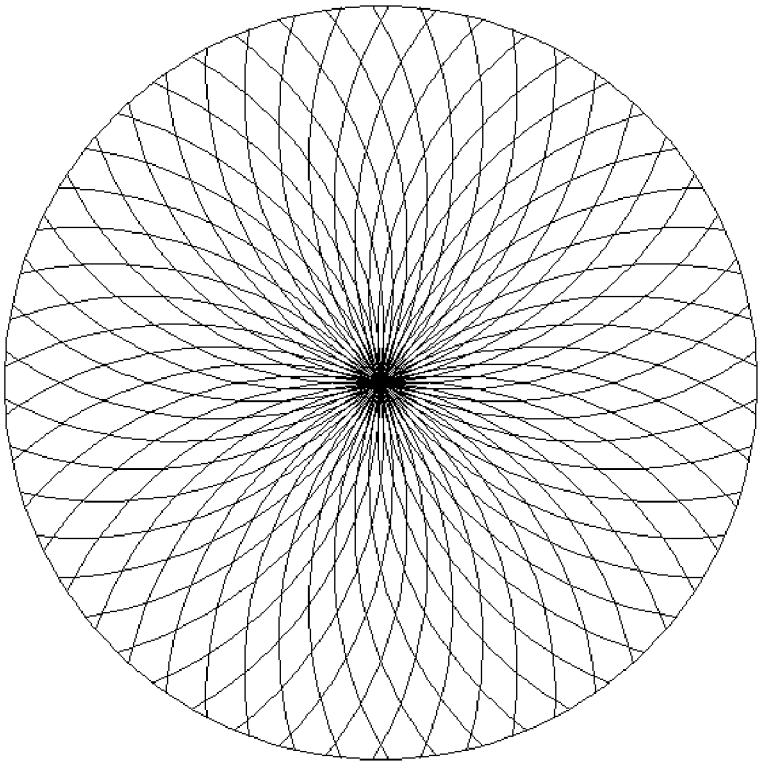
FIG. 2 depicts a CMP polishing layer having on its surface a consistent microtexture of furrows defined by intersecting arcs wherein each arc has a radius of curvature equal to or slightly greater than the radius of the CMP polishing layer.

In accordance with the present invention, grinding methods improve the surface microtexture of CMP polishing layers, include the top surface of CMP polishing pads and polishing layers. The methods create a consistent surface microtexture characterized by a series of intersecting arcs in the CMP polishing layer surface and having the same radius of curvature as a circle defined by the outer periphery of the grinding surface of the rotary grinder and by a surface roughness on the upper surface of the CMP polishing layer of from 0.01 to 25 μm, Sq. The present inventors have found that CMP polishing layers made in accordance with the methods of the present invention perform well with little or no conditioning, i.e. they are pre-conditioned. Further, the pad surface microtexture of the CMP polishing layers of the present invention enables enhanced polishing of substrates. The methods of the present invention help to avoid irregularities in pad morphology caused by skiving, which can cause surface defects, such as gouges, in chemical mechanical polishing pads as well as bubbling of window materials which are softer than the remainder of the CMP polishing layer. Further, the methods of the present invention help to minimize negative impacts caused by deformation of the polishing layer during pad stacking in which two or more pad layers are passed through nips set a fixed distance apart and linear waves result. This is especially important with soft and compressible CMP polishing layers. In addition, the methods of the present invention and the pads they provide enable optimized surface microtexture, lower defectivity and improved uniform material removal across a substrate surface, for example, semiconductor or wafer surface.

The present inventors have discovered that grinding with a porous abrasive material enables grinding without fouling the grinding media and without causing damage to the CMP polishing layer substrate. The pores in the porous abrasive material are large enough to store the particulates that are being removed from the CMP polishing layer substrate; and the porosity of the porous abrasive material is sufficient to store the bulk of the removed material during grinding. Preferably, blowing compressed air across the interface of the surface of the CMP polishing layer material (below) and the grinding surface of the rotary grinder (above) and the CMP polishing layer substrate further aids in removal of grinds and prevents fouling of the grinding equipment.

The porous abrasive material preferably is notched or comprises discontinuities or gaps around the periphery of the rotary grinder. Such gaps help to cool the grinding surface of the porous abrasive material and the CMP polishing layer substrate during grinding and to remove grinds in process. The gaps also permit the blowing of compressed gas or air into the interface between the surface of the CMP polishing layer and the grinding surface of the rotary grinder during grinding to remove grinds.

The methods of the present invention can be varied to compensate for undesirable CMP substrate wear profiles, such as where CMP processes result in inconsistent wear profiles, such as too little or too much removal at the edge of a substrate. This, in turn can extend pad life. In such methods, the grinding surface of the rotary grinder is adjusted so that it is substantially parallel but not exactly parallel to the top surface of the flat bed platen or CMP polishing layer. For example, the grinding surface of the rotary grinder can be adjusted to yield a center-thick (angle between the grinding surface of the rotary grinder and a flat bed platen radius in a plane that is normal to the flat bed platen and runs through the center point of the CMP polishing layer and the point on the periphery of the grinding surface of the rotary grinder that is located furthest from the center point of the CMP polishing layer is more than 180°) or center-thin (angle is less than 180°).

The methods of the present invention can be conducted in a wet environment, such as in conjunction with water or an abrasive aqueous slurry, such as a silica or ceria slurry.

The methods of the present invention are scalable to fit CMP polishing layers of various sizes, as the size of the rotary grinder element can be varied. In accordance with the methods of the present invention, the flat bed platen should be larger than the CMP polishing layer or, preferably, of a size having a radius that is equal to or within 10 cm longer than the radius of the CMP polishing layer. The methods thus are scalable to treat CMP polishing layers having a radius of from 100 mm to 610 mm.

The methods of the present invention remove the top surface of the CMP polishing layer to form the consistent pad surface microtexture and can be used to remove from 1 to 300 μm, or, preferably, from 15 to 150 μm, or, more preferably, 25 μm or more of pad material from the top surface of the CMP polishing layer.

The methods of the present invention enable the provision of CMP polishing layers or pads that do not suffer from window bulges and defects caused by skiving. Thus, in accordance with the present invention, a CMP polishing layer can be formed by molding a polymer to form a porous molding having a desired diameter or radius, which will be the size of pads made therefrom, then skiving the molding to a desired thickness, which will be the target thickness of a pad made in accordance with the present invention, followed by grinding the pad or CMP polishing layer to provide the desired pad surface microtexture on its polishing surface.

The methods of the present invention can be performed on single layer or solo pads, as well as on stacked pads having a subpad layer. Preferably, in the case of stacked pads the grinding methods are carried out after the pads are stacked so that grinding can help eliminate deformities in stacked pads.

The methods of the present invention include forming grooves in pads, such as by lathing the pads, after grinding them.

Suitable CMP polishing layers for use in accordance with the methods of the present invention preferably comprise a porous polymer or filler containing porous polymer material that has a Shore D hardness according to ASTM D2240-15 (2015) of from 20 to 80.

The methods of the present invention can be carried out on any pad, including those made from relatively soft polymers and find particular use in treating soft pads having a Shore D hardness of 40 or less. Pads can preferably be porous. Pores can be provided by spaces in the pad polymer matrix or by pore forming agents or microelements or fillers that contain voids or pores.

Suitable CMP polishing layers for use in accordance with the methods of the present invention may further comprise one or more, non-porous, clear window sections, such as those comprising a non-porous polyurethane having a glass transition temperature (DSC) of from 75 to 105° C., such as window sections not extending over the center point of the CMP polishing layer. In such CMP polishing layers, the one or more window sections has a top surface defined by a window thickness variation of 50 μm or less over the largest dimension of the window, such as the diameter of a round window, or the larger of the length or width of a rectangular window.

Further, suitable CMP polishing layers for use with the methods of the present invention may comprise a plurality of pores or microelements, preferably, polymeric microspheres, having an average particle size of from 10 to 60 μm.

In accordance with the present invention, soft CMP polishing layers having a polishing surface with a Shore D hardness of 40 or less also have a consistent pad surface microtexture, including a series of visibly intersecting arcs on the polishing surface and having a radius of curvature equal to or greater than, preferably, equal to the radius of the polishing layer. Preferably, the series of visibly intersecting arcs extends all the way around the surface of the polishing layer in radial symmetry with the center point of the polishing layer.

As shown in FIG. 1, the methods of the present invention are carried out on the surface of a flat bed platen (1) with vacuum ports, not shown. A CMP polishing layer or pad (2) is placed on the flat bed platen (1) so that the center point of the flat bed platen (1) and the CMP polishing layer (2) are aligned. The flat bed platen (1) in FIG. 1 has vacuum vents (not shown) to hold CMP polishing layer (2) in place. In FIG. 1, the CMP polishing layer (2) has one window (3). The grinding mechanism of the present invention comprises a rotary grinder (wheel) assembly (4) or rotor having attached at the underside of its periphery a grinding medium comprising a porous abrasive material (5) which, as shown, is arranged in a plurality segments extending around the underside of periphery of the rotor (4). The segments of the porous abrasive material have small gaps between them. In the FIG. 1, the rotary grinder assembly (4) is positioned as desired with its periphery just over the center point of the CMP polishing layer (2); further, the rotary grinder assembly (4) has the desired size such that its diameter is roughly equal to the radius of the CMP polishing layer (2).

The grinding apparatus used in the methods of the present invention comprises a rotary grinder assembly and its drive housing, including a motor and a gear linkage, as well as the flat bed platen. In addition, the apparatus comprises conduits for conducting compressed gas or air into the interface of the porous abrasive material attached to rotary grinder assembly and the CMP polishing layer. The entire apparatus is enclosed inside an airtight enclosure, wherein humidity is preferably controlled to an RH of 50% or less.

The rotary grinder assembly of the grinding apparatus used in the methods of the present invention spins on a vertical axle which extends into a drive housing and connects via a mechanical linkage such as a gear or a drive belt to a motor or rotary actuator within the drive housing. The drive housing further includes a radial array of two or more pneumatic or electronic actuators located adjacent above the rotary grinder assembly, whereby the rotary grinder assembly can be raised or lowered, such as by feeding it downward at a slow, incremental rate and tilted. The actuators further enable the tilting of the rotary grinder assembly so that its grinding surface is substantially but not exactly parallel to the top surface of the flat bed platen; this enables the grinding to create center-thick or center-thin pads.

The rotary grinder assembly contains an array of clips, fasteners, or a laterally spring loaded snap ring into which a ring of the porous abrasive material fits snugly on the underside of the rotary grinder assembly.

The porous abrasive material is carried on a single carrier ring which fits into or attaches to the underside of the rotary grinder assembly. The porous abrasive material can comprise of radially array of downward facing segments, usually from 10 to 40 segments of the porous abrasive material having gaps between them or a perforated ring made of the porous abrasive material having periodic perforations in it. The gaps or perforations allow the blowing of compressed gas or air into the interface of the surface of the CMP polishing layer and the CMP polishing layer to clean the porous abrasive material before, during or after use.

The pad surface microtexture of CMP polishing layers treated in accordance with the methods of the present invention is proportional to the surface roughness of the CMP polishing layer and to the size of the finely divided non-porous abrasive particles on the grinding surface of the rotary grinder. For example, a surface roughness of 1 μm, Sq. corresponds to a finely divided non-porous abrasive particles that have an average particle diameter (×50) of slightly less than 1 μm.

The flat bed platen in the apparatus of the present invention contains a plurality of small holes, for example, from 0.5 to 5 mm in diameter, through the platen which are connected to a vacuum. The holes can be arranged in any suitable manner to hold the CMP polishing layer substrate in place during grinding, such as, for example, along a series of spokes extending outward from the center point of the flat bed platen or in a series of concentric rings.

EXAMPLES

In the following examples, unless otherwise stated, all units of pressure are standard pressure (~101 kPa) and all units of temperature are room temperature (21-23° C.).

Example 1

Trials were conducted with two versions of a VP5000™ CMP polishing layer or pad (Dow Chemical, Midland, Mich. (Dow)) having a 330 mm (13") radius. The pads had no windows. In Example 1-1, the CMP polishing layer comprised a single porous polyurethane pad which was 2.03 mm (80 mil) thick, and wherein the polyurethane had a Shore D hardness of 64.9. In Example 1-2, the CMP polishing layer comprised a stacked pad having the same polyurethane pad of Example 1-1 stacked using a pressure sensitive adhesive onto a SUBA IV™ sub-pad made from polyester felt (Dow).

The Comparatives in Examples 1-A and 1-B were the same pads, respectively, as in Examples 1-1 and 1-2, but not treated in accordance with the methods of the present invention: The stacked pad had a SIV sub-pad.

All pads had 1010 grooves (a concentric circle groove pattern with 0.0768 cm (0.030") deep×0.0511 cm (0.020") wide×0.307 cm (0.120") pitch), and no window.

The porous abrasive material was a vitrified, porous diamond abrasive, having an average abrasive size of 151 μm. To grind the substrate, the rotary grinder assembly was positioned parallel to the top of the flat bed platen and was rotated counterclockwise at 284 rpm and the aluminum flat bed platen was rotated clockwise at 8 rpm. Starting from a point at which the porous abrasive material just begins to touch the CMP polishing layer substrate, the rotary grinder assembly was fed down towards the flat bed platen at a rate of 5.8 μm (0.0002") increments every 3 pad revolutions. During this time compressed dry air (CDA) was blown into the interface of the surface of the porous abrasive material and the CMP polishing layer from 2 nozzles, one located just above the center point of the CMP polishing layer and the other located at approximately 210 mm (8.25") from the pad center on the trailing side of the porous abrasive material. The grinding was continued for approximately 5 min.

The resulting pads from Example 1 were evaluated in polishing tests for removal rate, non-uniformity and chattermarks (defectivity), as follows:

Removal Rate:

Was determined on a 200 mm size tetraethoxysilicate (TEOS) substrate by planarizing the substrates using the indicated pads and an ILD3225™ fumed silica aqueous slurry (Dow) at 200 ml/min flowrate. Polishing pressure was varied from 0.11, 0.21 and 0.32 kg/cm$^2$ (1.5, 3.0, 4.5 psi) downforce at 93/87 platen/substrate carrier rpm, using a Mirra™ polishing tool (Applied Materials, Santa Clara, Calif.). Prior to testing all polishing pads were conditioned for 40 minutes at 3.2 kg (7 lbs) using as a conditioner a SAESOL™ 8031C1 disk (braised diamond dust surface, 10.16 cm in diameter, Saesol Diamond Ind. Co., Ltd., Korea). During testing, the same conditioning of the pads was continued. A total of 18 wafers were tested per pad and the averages obtained.

Non-Uniformity:

Was determined on the same TEOS substrate planarized in removal rate testing and in the manner disclosed in removal rate testing, except that the data were obtained by observing within-wafer thickness variation. A total of 18 wafers were tested per pad and the averages obtained.

Chattermarks or Defect Count:

Was determined on the same TEOS substrate planarized in removal rate testing and in the manner disclosed in removal rate testing, except that the data were obtained by observing the total number of CMP defects. A total of 18 wafers were tested per pad and the averages obtained.

The resulting pads had a pad surface microtexture comprising intersecting arcs having a radius of curvature equal to that of the periphery of the rotary grinder assembly. Also, as shown in Table 1, below, the inventive pads of Example 1-1 and 1-2 gave the same planarization rates on a substrate as the Comparative pads of Examples 1-A (solo) and 1-B (stacked); meanwhile, the inventive pads of Example 1-1 and 1-2 produced significantly lowered defectivity and dramatically fewer chatter marks in the substrate than the pads of Comparative Examples 1-A and 1-B which were not subject to the grinding methods of the present invention.

TABLE 1

Morphology and Polishing Performance - Small Pads

| | *Example 1-A | Example 1-1 | *Example 1-B | Example 1-2 |
|---|---|---|---|---|
| # of Samples | 5 | 5 | 4 | 4 |
| Removal Rate, Å/min | 3515 | 3468 | 3762 | 3737 |
| Non-Uniformity, % | 4.5 | 3.7 | 4.2 | 3 |
| Defect count, chattermarks (0.11 kg/cm$^2$) | 144 | 100 | 91 | 61 |
| Defect count, chattermarks (0.21 kg/cm$^2$) | 369 | 173 | 118 | 42 |
| Defect count, chattermarks (0.32 kg/cm$^2$) | 425 | 216 | 218 | 100 |

*Denotes Comparative Example.

Example 2

Trials were conducted with a large 419 mm (16.5") radius IC1000™ single layer polyurethane pads (Dow) having a Shore D hardness at 61.0, with the Example 2 pad treated in the manner as in Example 1 above, except that the rotary grinder assembly was fed down towards the flat bed platen at a rate of 20.3 μm (0.0007") increments every 8 pad revolutions and grinding was continued for 5.5 min. The Comparative Example 2-A pad was the same pad as in Example 2 not treated in accordance with the methods of the present invention.

Trials were run on 14 pads and average results are reported for thickness variation, which was tested, as follows:

Thickness Variation:

Was determined using a coordinate-measurement machine across the surface of the polishing pads. A total of 9 discrete measurement locations from pad center to edge were collected per pad. Thickness variation was calculated by subtracting the thinnest measurement from the thickest measurement. Results are shown in Table 2, below.

The resulting inventive pads had the characteristic pad surface microtexture. The inventive pads of Example 2 have less average thickness variation and so are more consistent in their shape than the comparative Example 2-A pad.

TABLE 2

| Morphology - Larger Pads | | |
|---|---|---|
| | Example 2-A* | Example 2 |
| # of Samples | 10 | 10 |
| Avg. Thickness Variation, μm | 17.66 | 7.42 |

*Denotes Comparative Example.

Example 3

Surface roughness was measured on the pads of Example 2, above, in comparison to commercially available IC1000™ pads (Dow). The Comparative Example 2-A pad was the same pad as in Example 2 but was not treated in accordance with the methods of the present invention.

Surface roughness was measured on at 5 evenly spaced points from pad center to edge on each of 2 pads and the average results are reported for surface roughness in Table 3, below.

TABLE 3

| Surface Roughness | | |
|---|---|---|
| | Example 3-A* | Example 3 |
| # of samples | 1 | 1 |
| Root Mean Square, (Sq) μm | 12.52 | 5.48 |
| Core Roughness Depth, Sk, μm | 14.82 | 10.17 |
| Reduced Peak Height, (Spk), μm | 7.60 | 4.93 |
| Reduced Valley Depths, (Svk), μm | 26.44 | 9.78 |

*Denotes Comparative Example.

As shown in Table 3, above, the CMP polishing layers of the present invention in Example 3 have a defined pad surface microtexture and a definite surface roughness characterized by a reduced valley depth.

Example 3

Trials were conducted with large 419 mm (16.5") radius IK2060H™ single layer polyurethane pads (Dow) having a Shore D hardness at 33.0, with the Examples 3-1, 3-2, 3-3 pads treated in the manner as in Example 2, above, except that the rotary grinder assembly was fed down towards the flat bed platen and stopped at different heights to achieve light (least grinding, stopped after removing 12.7 μm (0.5 mil) of the pad as measured from the highest peak on the pad surface at which the grinding surface first contacts the pad), medium (stopped after removing 50.8 μm (2 mil) of the pad as measured from the highest peak on the pad surface), and full surface microtexturing (most grinding, stopped after removing 101.6 μm (4 mil) of the pad as measured from the highest peak on the pad surface). The Comparative Example 3-A pad was the same pad as in Example 3-1, 3-2, and 3-3 but was not treated in accordance with the methods of the present invention.

All pads had 1010 grooves (a concentric circle groove pattern with 0.0768 cm (0.030") deep×0.0511 cm (0.020") wide×0.307 cm (0.120") pitch), and no window.

The resulting pads from Example 3 were evaluated in polishing tests for removal rate and defectivity, as follows:

Removal Rate:

Was determined on a 200 mm size tetraethoxysilicate (TEOS) substrate by planarizing the substrates using the indicated pads and an AP5105™ silica aqueous slurry (Dow) at 200 ml/min flowrate. Polishing pressure was constant at 0.11 kg/cm$^2$ (1.5 psi) downforce at 93/87 platen/substrate carrier rpm, using a Mirra™ polishing tool (Applied Materials, Santa Clara, Calif.). No pad break-in conditioning was performed prior to the wafer polishing. All polishing pads were full in-situ conditioned at 3.2 kg (7 lbs) using as a conditioner a SAESOL™ 8031C1 disk (braised diamond dust surface, 10.16 cm in diameter, Saesol Diamond Ind. Co., Ltd., Korea). During testing, the same conditioning of the pads was continued. A total of 76 wafers were tested per pad with a selected subset of 6 wafers measured (wafers no. 1, 7, 13, 24, 50 and 76); averages from the measured subset were obtained and are reported, below, for defect count and removal rate. Measurements from wafer no. 24 are also reported, below.

Defect Count:

Was determined on the same TEOS substrate planarized in removal rate testing and in the manner disclosed in removal rate testing, except that the data were obtained by observing the total number of CMP defects. A total of 76 wafers were tested per pad with a subset of 6 wafers measured and the averages obtained.

As shown in Table 4, below, the inventive pads of Example 3-2 and 3-3 gave significantly higher planarization rates on a substrate as the Comparative pad of Example 3-A; meanwhile, the inventive pads of Example 3-2 and 3-3 produced significantly lowered defectivity on the substrate than the pad of Comparative Example 3-A which were not subject to the grinding methods of the present invention. The Examples 3-2 and 3-3 when compared to Example 3-1 show that more grinding of the pad improves its polishing performance at least up to removal of ~51 microns of material from the pad surface.

TABLE 4

| Polishing Performance - Soft Pads | | | | |
|---|---|---|---|---|
| | *Example 3-A | Example 3-1 | Example 3-2 | Example 3-3 |
| Grind texture | None | Light | Medium | Full |
| # of Samples | 6 | 6 | 6 | 6 |
| Average Removal Rate, Å/min | 674 | 680 | 700 | 726 |
| Wafer 24 Removal Rate, Å/min | 693 | 681 | 723 | 759 |
| Average Defect count | 12116 | 12919 | 8902 | 7016 |
| Wafer 24 Defect count | 13311 | 13444 | 6614 | 4309 |

*Denotes Comparative Example.

We claim:

1. A method to provide a pre-conditioned chemical mechanical (CMP) polishing pad having a radius and a CMP polishing layer of one or more polymers and having a surface with a CMP polishing pad surface microtexture effective for polishing comprising:

grinding the surface of the CMP polishing layer with a rotary grinder while the CMP polishing layer is held in place on a flat bed platen surface, the rotary grinder having a grinding surface disposed parallel to or substantially parallel to the surface of the flat bed platen and made of a porous abrasive material to form an interface of the surface of the CMP polishing layer and the porous abrasive material, wherein the resulting CMP polishing layer has a surface roughness of from 0.01 μm to 25 μm, Sq.

2. The method as claimed in claim 1, wherein the CMP polishing layer is held in place on the flat bed platen surface by vacuum.

3. The method as claimed in claim 1, wherein the CMP polishing layer has a radius extending from its center point to its outer periphery and the rotary grinder has a diameter equal to or greater than the radius of the CMP polishing layer.

4. The method as claimed in claim 1, wherein the rotary grinder is positioned so that its outer periphery rests directly over the center of the CMP polishing layer during grinding.

5. The method as claimed in claim 1, wherein the rotary grinder and the CMP polishing layer and flat bed platen each rotate during the grinding of the CMP polishing layer.

6. The method as claimed in claim 5, wherein the flat bed platen rotates in the opposite direction as the rotary grinder.

7. The method as claimed in claim 5, wherein the rotary grinder rotates at a rate of from 50 to 500 rpm and the flat bed platen rotates at a rate of from 6 to 45 rpm.

8. The method as claimed in claim 1, wherein the rotary grinder is positioned above the CMP polishing layer and flat bed platen during the grinding, and the rotary grinder rotates and is fed downward from a point just above the CMP polishing layer surface at a rate of from 0.05 to 10 μm/revolution and, wherein, the rotary grinder, the CMP polishing layer and the flat bed platen each rotate, whereby the grinding surface of the rotary grinder grinds the surface of the CMP polishing layer.

9. The method as claimed in claim 1, wherein prior to the grinding, the CMP polishing layer is formed by molding the polymer and skiving the molded polymer to form the CMP polishing layer.

10. The method as claimed in claim 1, wherein prior to the grinding, a CMP polishing pad is formed by molding the polymer and skiving the molded polymer to form the CMP polishing layer, followed by stacking the CMP polishing layer on top of a subpad or subbing layer having the same diameter as the CMP polishing layer to form the CMP polishing pad.

11. The method as claimed in claim 1, wherein the porous abrasive material is a composite of a porous material continuous phase having dispersed within it finely divided non-porous abrasive particles.

12. The method as claimed in claim 11, wherein the porous abrasive material is a composite of a porous material continuous phase having dispersed within it finely divided diamond particles.

13. The method as claimed in claim 1, wherein during the grinding, the method further comprises blowing compressed inert gas or air intermittently or continuously into the interface of the surface of the CMP polishing layer and the grinding surface of the rotary grinder so as to impinge upon the porous abrasive material.

* * * * *